US005338155A

United States Patent [19]

Kreitmeier

[11] Patent Number: 5,338,155

[45] Date of Patent: Aug. 16, 1994

[54] MULTI-ZONE DIFFUSER FOR TURBOMACHINE

[75] Inventor: Franz Kreitmeier, Baden, Switzerland

[73] Assignee: Asea Brown Boveri Ltd., Baden, Switzerland

[21] Appl. No.: 98,814

[22] Filed: Jul. 29, 1993

[30] Foreign Application Priority Data

Aug. 3, 1992 [EP] European Pat. Off. ..... 92113180.1

[51] Int. Cl.[5] ..... F01D 7/00

[52] U.S. Cl. ..... 415/211.2

[58] Field of Search ..... 415/208.1, 208.2, 209.1, 415/211.2, 914

[56] References Cited

U.S. PATENT DOCUMENTS

| | | | |
|---|---|---|---|
| 3,552,877 | 1/1971 | Christ et al. | 415/211.2 |
| 4,013,378 | 3/1977 | Herzog | 415/211.2 |
| 4,802,821 | 2/1989 | Kreitmeier | 415/211.2 |
| 5,077,967 | 1/1992 | Widener et al. | 415/208.1 |
| 5,102,298 | 4/1992 | Kreitmeier | 415/211.2 |
| 5,203,674 | 4/1993 | Vinciguerra | 415/211.2 |
| 5,221,182 | 6/1993 | Arbeus | 415/208.1 |

FOREIGN PATENT DOCUMENTS

| | | | |
|---|---|---|---|
| 0265633 | 5/1988 | European Pat. Off. . | |
| 0417433 | 3/1991 | European Pat. Off. . | |
| 352534 | 2/1961 | Switzerland . | |
| 197873 | 5/1923 | United Kingdom | 415/211.2 |
| 1008886 | 11/1965 | United Kingdom . | |

*Primary Examiner*—John T. Kwon

*Attorney, Agent, or Firm*—Burns, Doane, Swecker & Mathis

[57] ABSTRACT

A multi-zone diffuser for an axial-flow turbomachine has a minimal overall length and a first zone with a minimal diameter. The kink angles of the diffuser inlet both at the hub and at the cylinder of the turbomachine are fixed exclusively for evening out the total pressure profile over the duct height at the outlet from the last rotor blade row. In the form of streamlined struts, are provided within the deceleration zone of the diffuser for the removal of swirl from the swirling flow. A first diffusion zone extends from the outlet plane of the last rotor blade row to a plane at the outlet of the streamlined struts and is configured as a single duct and as a bell shaped diffuser. A second diffusion zone is fashioned in the form of a multi-duct diffuser part, flow guide rings being arranged downstream of the streamlined struts.

18 Claims, 4 Drawing Sheets

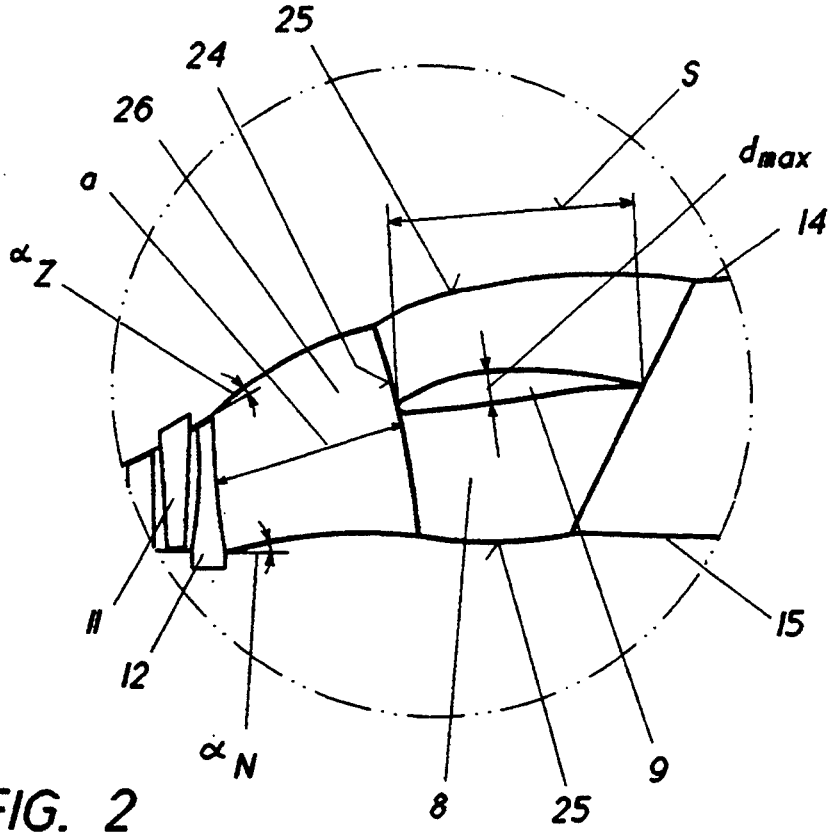
FIG. 2
FIG. 4
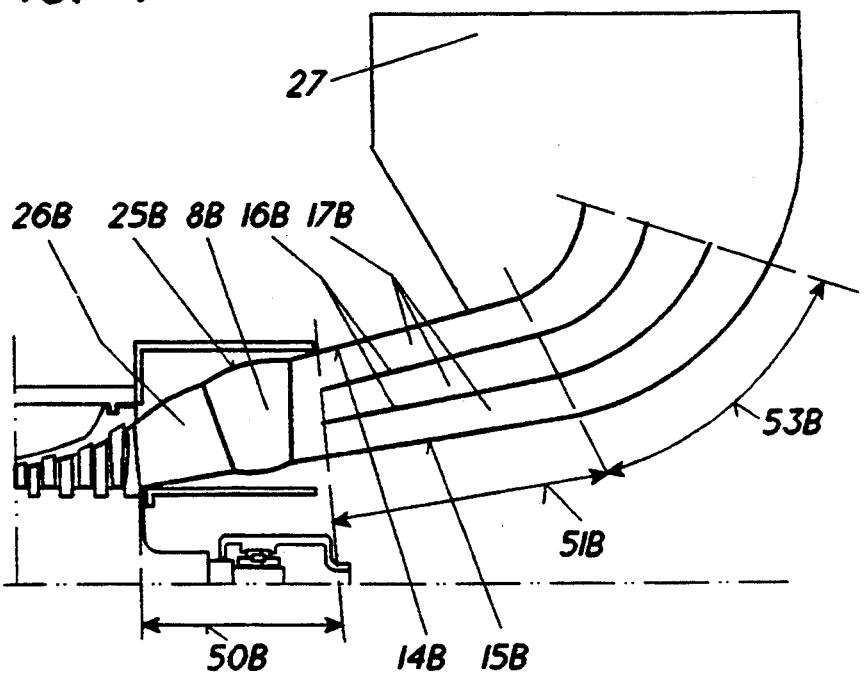

FIG. 5
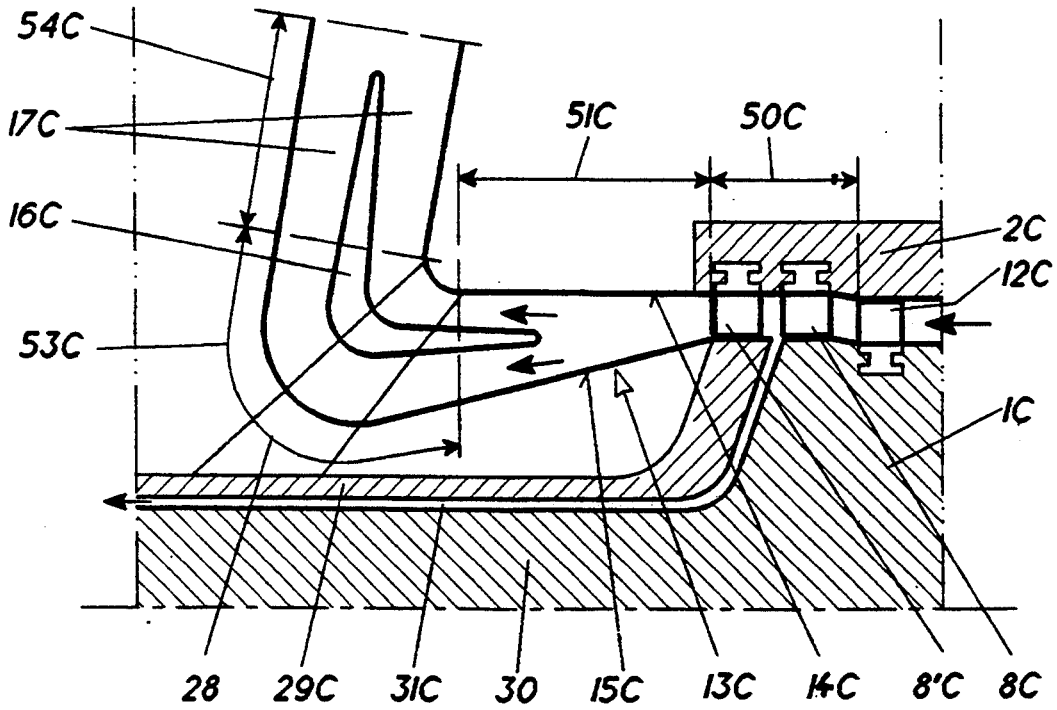
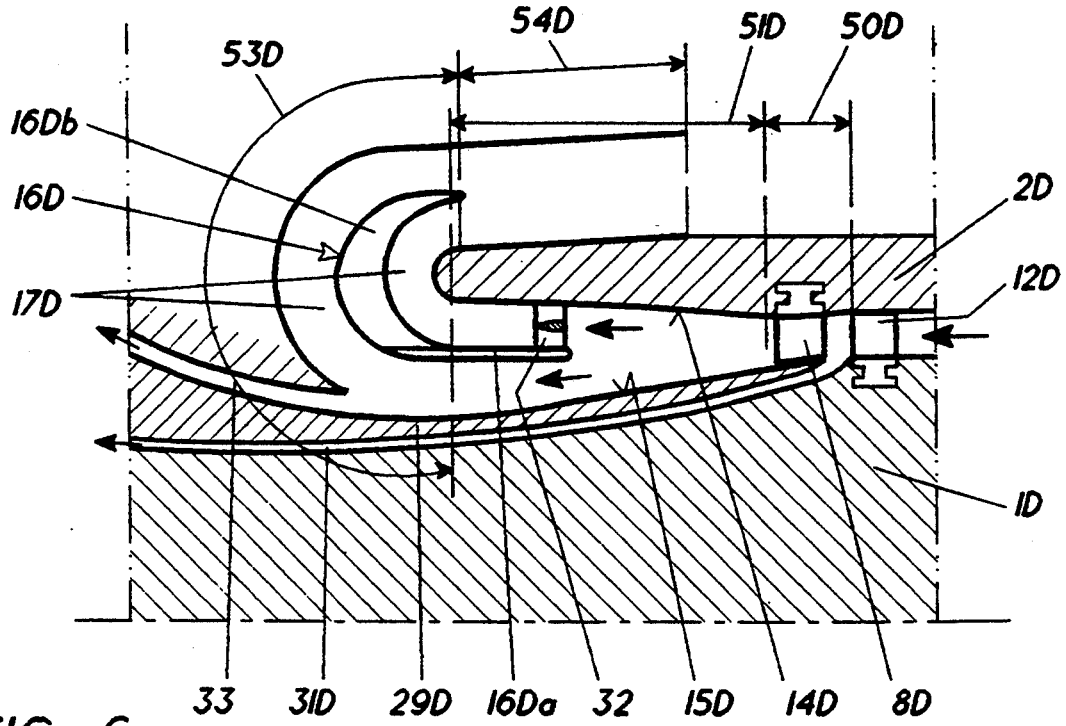
FIG. 6

MULTI-ZONE DIFFUSER FOR TURBOMACHINE

BACKGROUND OF THE INVENTION

1. Field of the Invention

The invention relates to a multi-zone diffuser for an axial-flow turbomachine in which the kink angles of the diffuser inlet both at the hub and at the cylinder of the turbomachine are fixed exclusively for the purpose of evening out the total pressure profile over the duct height at the outlet from the last rotor blade row, in which means, in the form of streamlined struts, are provided within the deceleration zone of the diffuser for the removal of swirl from the swirling flow, and in which flow guide rings subdivide the diffuser in multi-duct fashion.

2. Discussion of Background

Such multi-zone diffusers for turbomachines are known from EP-A 265 633. In order to meet the requirements there for the best possible pressure recovery and swirl-free diffuser outlet flow at part load, a straightening grid is provided within the diffuser and this grid extends over the complete height of the flow duct. These means for the removal of swirl involve cylindrical streamlined struts with thick straight profiles arranged uniformly around the periphery. These profiles are designed according to the knowledge available for the construction of turbomachines and are intended to be as insensitive as possible to oblique incident flow. The leading edges of these struts subjected to the incident flow are located relatively far behind the trailing edge of the last rotor blades in order to avoid excitation of the last blade row caused by the pressure field of the struts. This distance is dimensioned in such a way that the leading edge of the struts is located in a plane in which a diffuser area ratio of preferably three is present. This first diffusion zone between the blading and the streamlined struts is therefore intended to remain undisturbed because of the total rotational symmetry. The fact that no interference effects are to be expected between the struts and the blading may be attributed to the fact that the struts only become effective in a plane in which there is already a relatively low velocity level.

Because the opening angle of conventional highly-loaded blading of turbines far exceeds that of a good diffuser, the known diffuser is subdivided into a plurality of partial diffusers by means of flow guide rings in order to support the flow in the radial direction. These guide rings extend from a plane directly at outlet from the blading to a plane at which a diffusion ratio of three is reached, i.e. over the whole of the first diffusion zone. For vibration reasons, these guide rings should preferably be configured in one piece. This leads to a solution without a split plane, which is disadvantageous for assembly reasons. In addition, the guide rings lead to large diameters so that transport problems can arise.

A second diffusion zone extends from the leading edge of the thick streamlined struts to the maximum profile thickness of the struts. The de-swirling of the flow is intended to take place to a major extent in this second zone and, in fact, substantially without deceleration. In a third, subsequent diffusion zone in the form of a straight diffuser, the flow—which at this time is practically swirl-free—is further decelerated.

In addition to maximum pressure recovery, particularly at part load, all these measures are also intended to achieve a reduction in the design length of the installation.

In conventional gas turbines, the flow onto the diffuser at idle has a velocity ratio $c_t/c_n$ of approximately 1.2, where $c_t$ is the tangential velocity and $c_n$ is the axial velocity of the medium. This oblique incident flow leads to a reduction in the pressure recovery $C_p$.

In other types of machines, such as steam turbines or gas turbines for fluidized bed firing, it is quite possible for the volume flow to be reduced down to 40% so that $c_t/c_n$ ratios of up to 3 occur. In such types of machine, fixed diffuser geometry is not a possibility because the pressure recovery could even be negative. This applies even in the case where the pitch/chord ratio of the streamlined struts is 0.5. Streamlined struts with pitch/chord ratios of approximately 1, which would provide a somewhat larger pressure recovery at full load, i.e. $c_t/c_n$=approximately 0, cannot be used at all in such machines.

The large drop in pressure recovery may be attributed to the fact that a strong vortex forms between the outlet rotor blades and the streamlined struts in the case of the extreme relationships quoted. The vortex is bounded by the streamlined struts at which the tangential component of the velocity is dissipated. If solid particles (for example in gas turbines) or water droplets (for example in steam turbines) are entrained in the resulting reverse flow, there is an acute danger of root erosion on the blades of the last rotor row.

A known remedy in a turbomachine of the axial type, from EP 0 417 433 A1, is to arrange at least one row of variable guide vanes in the diffuser between the means for swirl removal and the outlet rotor blades. The means for removing the swirl within the diffuser are, in this case also, streamlined struts arranged evenly around the periphery with a straight camber line and symmetrical profile and with a pitch/chord ratio between 0.5 and 1 in the center section of the flow duct. These streamlined struts extend conically in the radial direction. The intention is that the part-load behavior of the machine should be further improved by these measures for designing the diffusion.

SUMMARY OF THE INVENTION

Accordingly, one object of this invention, on the basis of 3D optimization using Navier-Stokes calculation methods, is to keep the total length of the diffuser to a minimum in a multi-zone diffuser of the type mentioned at the beginning for a specified diffuser area ratio (by which is understood the ratio of the flow cross sections between the outlet and the inlet of the diffuser) and for the smallest possible diameter of the first diffusion zone and the greatest physically possible pressure recovery and swirl-free outlet flow.

This is achieved, in accordance with the invention, in that a first diffusion zone extends from the outlet plane of the last rotor blade row to a plane at the outlet from the streamlined struts and is configured as one duct in which the equivalent opening angle of the meridian contours downstream of the kink angles is reduced to avoid flow separation so that a type of bell-shaped diffuser is formed;

and in that a second diffusion zone is fashioned in the form of a multi-duct diffuser part, the flow guide rings being arranged downstream of the streamlined struts.

The advantage of the invention may be seen, inter alia, in that in the case of a strongly diverging flow, the kink angle idea can, for the first time, be carried out by means of a single-duct diffuser. The desired small diameter of the first diffusion zone is achieved because it is possible to dispense with the previous multi-duct nature of this zone. This diameter is decisive for the transportability of the assembled machine on railways. This even applies to the currently usual maximum unit powers of, for example, gas turbines.

It is particularly expedient for a third diffusion zone to be formed downstream of the second diffusion zone in the form of a dump diffuser whose axial length is substantially $L=D/n$, where D is the diameter of the flow duct (in the exhaust pipe) and n is the number of ducts in the second diffusion zone. By this means, flow inhomogeneities after the second diffusion zone can be evened out and the pressure recovery can be further increased. In addition, interference effects with subsequent flow components such as noise suppressors, boilers and the like can be avoided by this means. Furthermore, such an equalization zone reduces the sensitivity of the pressure recovery to part-load conditions.

It is useful for the ratio between a, the distance between the struts and the outlet from the blading, on the one hand, and the strut pitch t, on the other, to be at least 0.5 in order substantially to avoid interference with the last rotor row of the blading. This measure also provides complete utilization of the work capability of the flow medium.

If the ratio between the strut chord s and the strut pitch t is at least 1, this ensures that the sensitive diffuser flow is deflected into the axial outlet flow direction without separation and that a contribution is made to the desired deceleration.

Where the maximum ratio between the maximum profile thickness $d_{max}$ of the streamlined struts and the strut chord s is 0.15 and is substantially constant over the height of the struts, excessive velocities, local Mach number problems and various displacement effects are minimized by this means.

It is also appropriate for the leading edges the struts to be so oriented over the height of the struts that they are intersected at right angles by the streamlines. Together with the measure that $d_{max}/s=\text{constant}$, this ensures that the flow is not displaced radially outwards to form a hub separation.

The curvature of the camber line of the struts is advantageously selected with a view to shock-free entry and axial outlet flow. This ensures the desired high pressure recovery and a certain insensitivity at part load.

It is expedient for the meridian contour of the diffuser to be additionally widened in the region of the struts in order to avoid excessive velocities on the struts. Compensation is provided by this measure for the displacement effect caused by the struts, at least in the edge zones.

It is particularly useful for the diffuser to be provided with a horizontal split plane in the first diffusion zone. Because, in contrast to the solution mentioned at the beginning, the first diffusion zone is not equipped with guide rings, which are generally embodied in one piece for vibration reasons, the split plane ensures the possibility of uncovering the first zone and, therefore, of simple assembly and dismantling of the blading, for example, without auxiliary equipment and without axial displacement.

In the case of a split plane in the first diffusion zone, an even number of struts is provided, struts being arranged in the vertical plane but not in the horizontal plane. The lower vertical strut can therefore be used for supporting the diffuser and it is possible to dispense with split struts.

The possibility exists of providing, in the second diffusion zone, a plurality of hollow profiled struts, which have defined separation edges, are arranged evenly distributed about the periphery and are arranged symmetrically about the vertical plane. This provides the possibility of ventilating the hub body by natural convection. The necessary supply conduits for the bearing arrangement and for the cooling of the rotor and casing can be led through these hollow struts. If necessary, the blow-off quantities necessary for the compressor of a gas turbine installation can also be mixed with the exhaust gas through these hollow struts.

It is useful to provide the inner annular wall of the diffuser with a defined separation edge at the outlet from the second diffusion zone. By this means, the separation cross section is minimized, on the one hand, and the evening of the flow inhomogeneities is accelerated, on the other.

BRIEF DESCRIPTION OF THE DRAWINGS

A more complete appreciation of the invention and many of the attendant advantages thereof will be readily obtained as the sample becomes better understood by reference to the following detailed description when considered in connection with the accompanying drawings, in which a plurality of embodiment examples of the invention are represented diagrammatically and in a simplified manner and wherein:

FIG. 2 shows the detail 2 of FIG. 1 to an enlarged scale;

FIG. 4 shows a partial longitudinal section of a gas turbine with axial/radial exhaust gas diffuser;

FIG. 5 shows a partial longitudinal section of the compressor of a gas turbine installation with a single upright combustion chamber;

FIG. 6 shows a partial longitudinal section of the compressor of a gas turbine installation with an annular combustion chamber.

DESCRIPTION OF THE PREFERRED EMBODIMENTS

Figure 1:
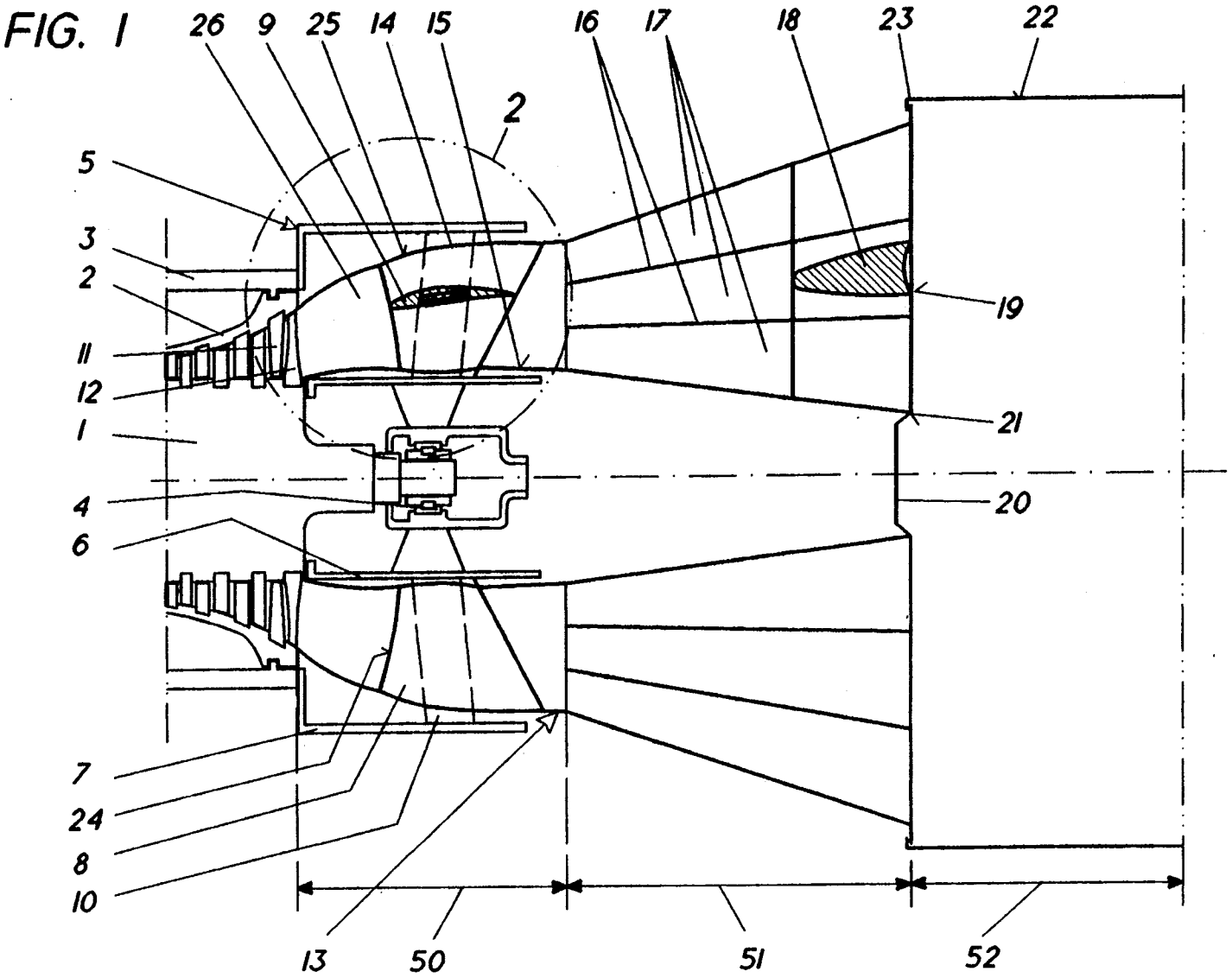
FIG. 1 shows a partial longitudinal section of a gas turbine with a diffuser according to the invention.
Figure 3:
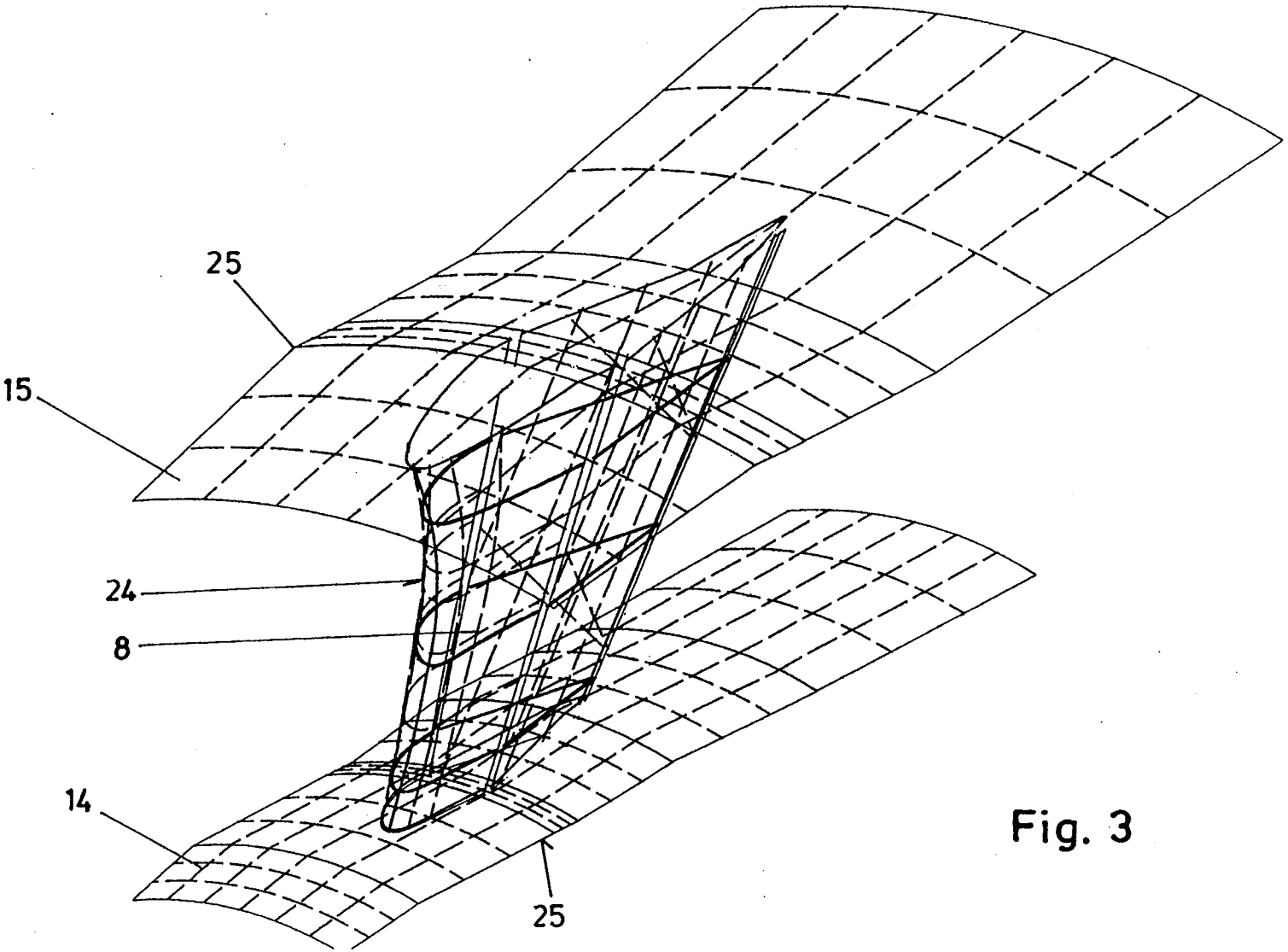
FIG. 3 shows a perspective view of a flow-oriented strut in the form of grid lines.

Referring now to the drawings, wherein like reference numerals designate identical or corresponding parts throughout the several views, but with different indices, where only the elements essential to understanding the invention are shown in the gas turbine of FIG. 1 with axial/axial exhaust gas diffuser (parts of the installation not shown, for example, are the compressor part, the combustion chamber and the complete exhaust pipe and chimney), where the embodiment example shown in FIG. 1, 2 and 3 carries no indices, where the kink angles are only shown as such in FIG. 2 for ease of comprehension and where the flow direction of the working medium is shown by arrows, the gas turbine, of which only the three last, axial-flow stages are represented in FIG. 1, consists essentially of the bladed rotor 1 and the vane carrier 2 equipped with guide vanes. The vane carrier is suspended in the turbine casing 3. The rotor is supported in a support bearing 4 which is in turn supported in an exhaust gas casing. In the case of the example, this exhaust gas casing consists essentially of a hub-end, inner part 6 and an outer part 7, which bound the diffuser 13. Both elements 6 and 7 are cup-shaped casings with a horizontal split plane at the level of the center line. They are connected together by a plurality of welded streamlined support struts 8, which are arranged evenly distributed over the periphery and whose profile is indicated by 9. The exhaust gas casing is conceived in such a way that it is not in contact with the exhaust gas flow. The actual flow guidance is undertaken by the diffuser whose first zone is laid out as an insert in the exhaust gas casing. For this purpose, the outer boundary wall 14 and the inner boundary wall 15 of the diffuser are held by means of the streamlined struts 8. The walls, in this arrangement, are penetrated by the actual support bodies 10 which extend within the streamlined struts and hold the exhaust gas casing 6, 7.

The kink angle, directly at outlet from the blading, of the two boundary walls 14 and 15 of the diffuser is then decisive for the desired mode of operation of the diffuser. The blading is highly-loaded reaction blading with a large opening angle. The flow through the last rotor blade row occurs at high Mach number. The passage contour at the blade root is cylindrical and that at the blade tip extends obliquely at an angle of approximately 30°. If this conicity were to be continued in the diffuser, the quoted angle of 30° would be completely unsuitable for decelerating the flow and achieving the desired rise in pressure. The flow would separate at the walls. Purely design considerations would generally lead to a reduction in the diffuser angle from 30° to 7°. The deflection of the streamlines caused by this at the kink positions at diffuser inlet, and the associated detrimental increase in pressure, however, reduces the heat drop, i.e. the gas work over the blading. The result of this is less power. The energy not employed leads to excessive local velocities at diffuser outlet and is then dissipated in the exhaust pipe.

The diffuser is therefore designed exclusively from aerodynamic points of view. The considerations must lead to achieving the most homogeneous total pressure profile possible over the complete duct height, i.e. also at the hub and the cylinder. The two kink angles are therefore determined on the basis of the total flow in the blading and in the diffuser.

The equation for radial equilibrium teaches that the meridian curvature of the streamlines is mainly responsible for the amount of the increase in pressure mentioned above. It is, therefore, primarily necessary to influence the latter by adapting the setting angle in order to achieve a homogeneous total pressure distribution. In principle, this consideration fixes the kink angle $\alpha_N$(FIG. 2) of the inner boundary wall 15 at the diffuser inlet. In the present case, this leads to an angle $\alpha_N$ which rises from the horizontal in the positive direction and, specifically, by almost 15°. This may also, inter alia, be attributed to the influence of the cooling air. As is known, the hub, i.e. the rotor surface and the blade roots, are generally cooled down by cooling air to a tolerable level. Part of this cooling air then flows along the rotor surface into the main duct. This cooling air has a lower temperature than the main flow and this causes low energy zones immediately at the hub behind the last rotor blade. This fact, which is specific to gas turbines, leads to the necessity of forcing the pressure gradient mentioned at this low-energy position. This is achieved by an increased setting angle of the inner boundary wall 15 and a meridional deflection of the flow caused by it. The energy built up by this means prevents separation of the flow on the hub of the diffuser. It may be recognized from all this that an arbitrary (for example, cylindrical) continuation of the inner boundary wall of the diffuser would, in any event, be unsuitable for providing compensation for the typical outlet flow deficiency.

The same considerations now have to be applied with respect to the kink angle $\alpha_Z$ at the cylinder, i.e. at the outer boundary wall 14. In this case, however, it is necessary to allow for the fact that there is a very high-energy flow here because of the flow through the gap between the blade tip and the vane carrier 2. In addition, the flow is strongly swirling. A homogeneous energy distribution can only be achieved here if the kink angle $\alpha_Z$ at the cylinder is, in any event, opened outwards relative to the splay angle of the blading duct. In the case of the example, this takes place by an additional 10°.

As a result, it is found that the total opening angle of the diffuser is in the region of the opening angle of the blading and can even be greater than the latter. In no case, however, does it take up a value which would correspond to purely design considerations, This creates the conditions for the pressure conversion in the following diffuser to take place in such a way that there is a homogeneous, even outlet flow present at the outlet from the diffuser.

It is now, however, clear that a diffuser with a 30° opening angle is unsuitable for decelerating the flow. In the known diffuser mentioned at the beginning, the duct is therefore subdivided in the radial direction into a plurality of partial diffusers by means of flow guide rings, which are dimensioned in accordance with the known rules.

The present invention, however, is based on the idea of configuring the first diffusion zone 50 as one duct. The flow guidance parts of this first diffusion zone 50 are represented in FIG. 2. In order to achieve the one-duct arrangement, a so-called bell-shaped diffuser 26 is employed. This means that the equivalent opening angle $\Theta$ of the meridian contours downstream of the kink angles $\alpha_Z$ and $\alpha_N$, fixed according to the above criteria, is reduced in order to avoid flow separation. This takes place to a greater extent initially and subsequently to a lesser extent, leading to the bell shape shown. The equivalent opening angle $\Theta$ is here understood to mean:

$$\tan \Theta/2 = \frac{1}{U} \cdot \frac{dA}{ds}$$

where

U = the local periphery of the flow cross section;

dA = the local change in the flow cross section;

ds = the local change in the flow path along the diffuser.

Likewise, in contrast to the known diffuser mentioned at the beginning, the first diffusion zone 50 extends, in the present case, from the outlet plane of the last blade row to a plane at outlet from the streamlined struts 8. The latter are therefore included and their type, their design, their arrangement and their number are based on the following considerations.

The distance a between the leading edge 24 of the streamlined struts 8 and the outlet from the blading is first fixed as a ratio relative to the strut pitch t—which is a measure of the number of struts. If this ratio is at least 0.5, interference with the last rotor row 12 of the blading can be substantially avoided.

Two points have to be taken into account in the present case when determining the chord length of the streamlined strut. If the streamlined strut has a load-bearing function, its cross section must not be less than a minimum value. Sufficient space must be created within the strut for the arrangement of the support body 10. The chord length of the streamlined strut must, likewise, not be less than a minimum quantity with respect to its deflection duty—the swirling flow is to be straightened by means of it. If the ratio of the strut chord s to the strut pitch t is at least 1, both duties can be undertaken.

If the chord length has been fixed, and also the strut pitch by means of the ratio s/t, the number of streamlined struts is, in principle, given. The arrangement of these struts is then subject to the following criteria. In order to permit access to the blading and the bearing arrangement, the first diffusion zone 50 is provided with a horizontal split plane, i.e. the outer boundary wall 14 and the inner boundary wall 15 of the diffuser are embodied so that they are divided. It is preferable not to locate any streamlined struts in this horizontal split plane so as to avoid division of the struts. On the other band, it seems obvious to arrange the streamlined struts in the vertical plane. The vertically directed streamlined strut of the lower half can, by this means, be used for support functions. If an even number of struts is, in addition, demanded for reasons of symmetry, the result is a minimum number of 6 streamlined struts over the periphery, which can be quite useful for smaller machines. The next possible number of struts, and the most suitable for present purposes, is 10. An even higher number would already impair the flow cross section and substantially increase the complexity.

The ratio between the maximum profile thickness $d_{max}$ of the streamlined struts and the strut chord s should be at most 0.15 and is kept substantially constant over the height of the struts. These—again in contrast to the streamlined struts in the diffuser mentioned at the beginning—relatively thin struts avoid local Mach number problems and minimize various displacement effects over the vane height.

Again in contrast to the streamlined struts in the diffuser mentioned at the beginning, the streamlined struts are configured so that they are curved. The curvature of the camber line of the struts is selected, in this case, in terms of a shock-free inlet and an axial outlet flow. This leads to variable curvature over the strut height.

As may be seen from FIGS. 1 and 2 and in particular from FIG. 3, the struts are fundamentally conical. This is based on the idea of s/t=constant over the strut height. This configuration, which is independent of radius, forms the starting point which is subsequently adapted section by section to the actual flow over the height of the struts. For this purpose, the leading edges 24 of the struts are so oriented over the height of the struts that they are intersected at right angles by the streamlines. This leads to leading edges which do not by any means have to be radially directed, as is clearly shown in FIG. 3.

As a departure from the bell shape, the meridian contour of the diffuser is additionally widened in the region of the struts 8. This measure is at least taken in the region 25 from the strut leading edge 24 to the maximum profile thickness. Excessive velocities on the struts can be substantially avoided by this means.

This first diffusion zone 50, which ends at the outlet from the streamlined struts, is laid out with an area ratio of 1.8.

The first diffusion zone is followed by a second diffusion zone 51 in the form of a multi-duct diffuser part. It is laid out with an area ratio of 2.5. For this purpose, two flow guide rings 16 are arranged downstream of the struts 8 and these guide rings subdivide the duct into three partial diffusers 17. The partial diffusers are configured as straight diffusers in accordance with the rules known per se with equivalent opening angles of approximately 7.5° in each case. This measure achieves a shortening of the second diffusion zone in accordance with the rule $L=L_{1K}/n$. In this, L signifies the axial extent of the second diffusion zone, $L_{1K}$ the axial extent of a single-duct diffuser with the same area ratio and n the number of partial diffusers.

Three hollow profiled struts 18 are arranged at the end of this second diffusion zone 51, evenly distributed over the periphery, one of these hollow struts standing vertically in the upper half. Electrical conductors and air and oil conduits can be fed through these hollow struts. The blunt trailing edges of these hollow struts are provided with defined separation edges 19. The annular inner boundary wall 15 of the diffuser, which ends at the outlet from the second diffusion zone 51 with a blunt end 20, is also provided with a defined separation edge 21 of this type. By means of these measures, the separation cross section is kept as small as possible, the evening of the flow is accelerated and the hub dead water region is reduced.

Because of the way it fans out, this second diffusion zone 51 has a considerably larger diameter than the first diffusion zone 50. Since, however, the second zone only involves a purely sheet-metal construction, which can be assembled from dismantled parts without difficulty at the installation site, this fact does not entail any difficulties, particularly with respect to railway transport.

A third diffusion zone 52 in the form of a dump diffuser is provided downstream of the second diffusion zone 51, this dump diffuser involving a sudden expansion of area. The axial length of this Carnot diffuser, conceived as a smoothing zone, is L=D/n, where D is the diameter of the flow duct in the cylindrical exhaust pipe 22 and n is the number of ducts in the second diffusion zone 51. The area ratio of this third diffusion zone 52 is 1.2, it being also necessary to take account of the wake of the three hollow struts in this figure.

The total area ratio of the diffuser is therefore 5.3.

As a rule, both the cylindrical exhaust pipe 22 and the outer boundary wall 14 of the second diffusion zone 51 are welded together on site to form a single-part element. In order to ensure free access to the second diffusion zone, the second diffusion zone 51 is designed so that it can be pushed axially into the third diffusion zone 52, as is indicated diagrammatically at 23 in FIG. 1.

The new measure also makes it possible to permit a certain counter-swirl at the outlet from the last rotor blades 12 because axial straightening by the streamlined struts takes place downstream in the diffuser. This counter-swirl offers the following advantages:

the stage work can be increased at constant efficiency or the efficiency can be increased at constant stage work;

the blades of the last rotor row could be configured with less twist, which makes them cheaper;

the deflection in the last turbine stage can be reduced, which is effective with respect to particle separation, particularly in the case of gas turbines with fluidized bed firing.

The invention is obviously not limited to the embodiment example described and shown in FIGS. 1 and 2, which has as its object matter a diffuser with axial outlet and which therefore greatly facilitates the arrangement of the streamlined struts. It is, in particular, also applicable in the case of steam turbines or gas turbines in general, and in particular, in the case of turbines of exhaust gas turbochargers, as well as in the case of gas turbine compressors which, as a rule, all have a so-called axial/-radial or axial/radial/axial diffuser.

Such an example is represented by means of a gas turbine in FIG. 4. In this case, the first diffusion zone 50B corresponds to that of FIG. 1. The second diffusion zone 51B, which is subdivided by means of 2 guide rings 16B into three partial diffusers 17B, opens into a third diffusion zone 53B which has strong deflection with only slight deceleration. This strong deflection is greatly favored by the arrangement of the guide rings, which continue into the diffusion zone 53B. This measure effects a reduction of the average radius of curvature of the third diffusion zone in accordance with the rule $R=R_{1K}/n$. In this, R signifies the radius of curvature of the third diffusion zone, R1K the average radius of curvature of a single-duct diffusion zone with the same area ratio and n the number of ducts. The third diffusion zone 53B opens radially into the chimney 27. The idea of a dump diffuser is again effected in this transition to the chimney.

As a variation from the solution represented in FIG. 1, the streamlined struts can also be configured so that they are solid instead of hollow. This solution is useful if, for example, an actual exhaust gas casing is dispensed with, i.e. if the exhaust gas casing takes over the flow guidance duties, i.e. if the outer boundary wall 14 of the diffuser forms the termination towards the outside and is directly flanged onto the turbine casing.

FIG. 5 shows how the idea of the invention can be effected in the case of a compressor diffuser. In this case, the compressor could, for example, be that of the gas turbine shown in FIG. 1, it being then possible for the installation to be equipped with a single upright combustion chamber (not represented). The latter configuration leads to the almost radial outlet from the diffuser, as represented.

In order to de-swirl the flow in the present case, both a conventional compressor guide vane row and a downstream guide vane row are provided in the first diffusion zone. They take over the function of the streamlined struts. The compressor guide vane row acting as the first streamlined strut 8C is laid out in accordance with the criteria mentioned above but axial outlet from the strut is dispensed with because a downstream guide vane row 8'C follows the strut 8C in the flow direction for the further straightening of the flow. The downstream guide vane row 8'C can also, of course, be laid out in accordance with the criteria quoted. The first diffusion zone extends from the trailing edge of the rotor blade 12C to a plane behind the downstream guide vane row 8'C. The two struts 8C and 8'C could, of course, also be combined into a single streamlined strut.

The second diffusion zone is subdivided by a guide ring 16C into two partial diffusers 17C. This guide ring is held in position by means of struts 28 on a rotor cover 29C and on the outer boundary wall 14C in a third diffusion zone 53C with little deceleration but strong deflection. In this embodiment example, the third diffusion zone merges into a fourth diffusion zone 54C in which further deceleration occurs.

In such a single-shaft axial-flow gas turbine, the shaft part located between the turbine and the compressor is configured as a drum 30. This is surrounded by the rotor cover 29C, already mentioned. The annular duct 31C formed between the drum and the rotor cover undertakes the guidance of the total rotor cooling air, which is extracted at the hub end between the struts 8C and 8'C of the compressor and passed to the end face of the turbine from where it reaches the rotor-end cooling ducts. This rotor-end cooling air is fed into the annular duct 31C together with its associated swirl. This ensures, on the one hand, that the heating of the rotor by the cooling air, and therefore the level of the transient stresses, is as small as possible. In addition, the cleanest possible, almost dust-free air is introduced into the annular duct due to the extraction at the hub end. For the subsequent diffuser, the air extraction has the advantage that the marked low-energy zone at the hub (in the case of compressors) is substantially drawn off, which creates better conditions with respect to the diffuser inlet. It is obvious that this measure has to be taken into account in the determination of the kink angles at the outlet from the rotor blade 12C and in the layout of the single-duct bell-shaped diffuser in the first diffusion zone.

The variant of the multi-zone diffuser represented in FIG. 6 is suitable for installations which are equipped with an annular combustion chamber. The space relationships available lead to an almost 180° deflection of the diffuser flow. In this embodiment, only one compressor guide vane row is provided and this takes over the function of the streamlined struts 8D. They are laid out in accordance with the criteria which have already been mentioned several times. In consequence, the rotor-end cooling air at the hub is extracted, in this case, directly at the outlet from the last rotor blades 12D and led into the annular duct 31D. Relative to the embodiment of FIG. 5, therefore, the cooling air in this case has less pressure but more swirl, assuming that the sample conditions are present at outlet from the rotor blades in both compressors.

Here again, the second diffusion zone is subdivided by a guide ring 16D into two partial diffusers 17D. This guide ring is held in position by means of struts (not represented) on the rotor cover 29D and on the outer boundary wall 14D in a third diffusion zone 53D with little deceleration but strong deflection. In this embodiment example, the third diffusion zone merges into a single-duct fourth diffusion zone 54D, in which further deceleration takes place.

The guide ring is embodied in two parts. In its first section, it consists of a cylindrical sheet-metal shell 16D*a*, which is held in its position on the vane carrier 2D by means of a plurality of profiled struts 32 distributed over the periphery. In its second deflecting section 16Db, it consists of a cast part, for example, which is bolted to the first part. Air is branched off from the third diffusion zone via a further annular duct 33 for cooling the combustion chamber walls.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a multi-zone diffuser for an axial-flow turbomachine, in which the kink angles of the diffuser inlet both at a hub and at a cylinder of the turbomachine are fixed exclusively for the purpose of evening out the total pressure profile over the duct height at the outlet from the last rotor blade row, in which means, in the form of streamlined struts, are provided within the deceleration zone of the diffuser for the removal of swirl from the swirling flow, and in which flow guide rings subdivide the diffuser in multi-duct fashion, the improvement wherein a first diffusion zone extends from the outlet plane of the last rotor blade row to a plane at the outlet from the streamlined struts and is configured as one duct in which downstream of the kink angles an equivalent opening angle of the meridian contours at least in the region of the struts decreases in the flow direction, to avoid flow separation so that a type of bell-shaped diffuser is formed;

and wherein a second diffusion zone is fashioned in the form of multi-duct diffuser part, flow guide rings being arranged downstream of the streamlined struts.

2. The multi-zone diffuser as claimed in claim 1, wherein a third diffusion zone is formed downstream of the second diffusion zone in the form of a dump diffuser whose axial length is substantially $L=D/n$, where D is the diameter of the flow duct in the exhaust pipe and n is the number of ducts in the second diffusion zone.

3. The multi-zone diffuser as claimed in claim 1, wherein the ratio between the distance between the struts and the outlet from the blading, on the one hand, and the strut pitch, on the other, is at least 0.5 in order substantially to avoid interference with the last rotor row of the blading.

4. The multi-zone diffuser as claimed in claim 1, wherein the ratio between the strut chord and the strut pitch is at least 1 and is substantially constant over the height of the struts in order to secure execution of the deflection duty.

5. The multi-zone diffuser as claimed in claim 1, wherein the maximum ratio between the maximum profile thickness of the streamlined struts and the strut chord is 0.15 and is substantially constant over the height of the struts.

6. The multi-zone diffuser as claimed in claim 1, wherein the respective curvature of the camber line of the streamlined strut provides shock-free entry and axial outlet flow over the whole height of the struts.

7. The multi-zone diffuser as claimed in claim 1, wherein the meridian contour of the diffuser is additionally widened in the region of the struts in order to avoid excessive velocities on the streamlined struts.

8. The multi-zone diffuser as claimed in claim 1, wherein the leading edges of the streamlined strut are intersected at right angles by the streamlines.

9. The multi-zone diffuser as claimed in claim 1, wherein the diffuser is provided with a horizontal split plane in the first diffusion zone.

10. The multi-zone diffuser as claimed in claim 1, wherein a plurality of hollow profiled struts, which have defined separation edges, are arranged evenly distributed about the periphery and are arranged symmetrically about the vertical plane, are provided in the second diffusion zone.

11. The multi-zone diffuser as claimed in claim 1, wherein the inner boundary wall of the diffuser at the outlet from the second diffusion zone is provided with a defined separation edge.

12. The multi-zone diffuser as claimed in claim 1, wherein a third, likewise multi-duct diffusion zone, in which there is weak deceleration but strong deflection, is arranged downstream of the second diffusion zone.

13. The multi-zone diffuser as claimed in claim 1, wherein the maximum ratio between the maximum profile thickness of the streamlined struts and the strut chord is 0.15 and is substantially constant over the height of the struts.

14. The multi-zone diffuser as claimed in claim 2, wherein the second diffusion zone extends axially into the third diffusion zone.

15. The multi-zone diffuser as claimed in claim 9, wherein an even number of streamlined struts is provided, struts being arranged in the vertical plane but not in the horizontal plane.

16. The multi-zone diffuser as claimed in claim 12, wherein a fourth, single-duct or multi-duct diffusion zone, in which there is strong deceleration but weak deflection, is arranged downstream of the third diffusion zone.

17. In a multi-zone diffuser for an axial-flow turbo machine, in which kink angles of a diffuser inlet both at a hub and at a cylinder of the turbomachine are fixed exclusively for the purpose of evening out a total pressure profile over a duct height at an outlet from the last blade row, in which means, in the form of streamlined struts, are provided within a deceleration zone of the diffuser for the removal of swirl from the swirling flow, and in which flow guide rings subdivide the diffuser in multi-duct fashion, the improvement being a first diffusion zone extending from the outlet plane of the last rotor blade row to a plane at the outlet from the streamlined struts, said first zone configured as one duct in which the equivalent opening angle of the meridian contours downstream of the kink angles decreases in the flow direction so that a type of bell-shaped diffuser is formed to avoid separation of the flow from the contours of the diffuser duct;

a second diffusion zone is fashioned in the form of a multi-duct diffuser part, flow guide rings being arranged downstream of the streamlined struts, and the ratio between the distance between the struts and the outlet from the blading, on the one hand, and the strut pitch, on the other, is at least 0.5 in order substantially to avoid interference with the last rotor row of the blading.

18. The multi-zone diffuser as claimed in claim 17, wherein the ratio between the strut chord and the strut pitch is at least 1 and is substantially constant over the height of the struts in order to secure execution of the deflection duty.

* * * * *